US005992175A

United States Patent [19]

Yao et al.

[11] Patent Number: 5,992,175

[45] Date of Patent: Nov. 30, 1999

[54] ENHANCED NGL RECOVERY PROCESSES

[75] Inventors: Jame Yao; Jong Juh Chen, both of Sugar Land; Douglas G. Elliot, Houston, all of Tex.

[73] Assignee: IPSI LLC, Houston, Tex.

[21] Appl. No.: 08/987,183

[22] Filed: Dec. 8, 1997

[51] Int. Cl.[6] ..... F25J 3/02

[52] U.S. Cl. ..... 62/621

[58] Field of Search ..... 62/620, 621, 628, 62/618

[56] References Cited

U.S. PATENT DOCUMENTS

| | | | |
|---|---|---|---|
| 3,592,015 | 7/1971 | Streich et al. | 62/24 |
| 4,171,964 | 10/1979 | Campbell et al. | 62/24 |
| 4,251,249 | 2/1981 | Gulsby | 62/28 |
| 4,278,457 | 7/1981 | Campbell et al. | 62/24 |
| 4,318,723 | 3/1982 | Holmes et al. | 62/20 |
| 4,350,511 | 9/1982 | Holmes et al. | 62/17 |
| 4,596,588 | 6/1986 | Cook | 62/26 |
| 4,617,038 | 10/1986 | Mehra | 62/17 |
| 4,680,042 | 7/1987 | Mehra | 62/17 |
| 4,687,499 | 8/1987 | Aghili | 62/24 |
| 4,690,702 | 9/1987 | Paradowski et al. | 62/23 |
| 4,692,179 | 9/1987 | Mehra | 62/17 |
| 4,698,081 | 10/1987 | Aghili | 62/24 |
| 4,851,020 | 7/1989 | Montgomery, IV | 62/24 |
| 4,885,063 | 12/1989 | Andre | 203/73 |
| 5,275,005 | 1/1994 | Campbell et al. | 62/24 |
| 5,421,165 | 6/1995 | Paradowski et al. | 62/24 |
| 5,566,554 | 10/1996 | Vijayaraghavan et al. | 62/621 |
| 5,588,306 | 12/1996 | Schmidt | 62/614 |
| 5,600,969 | 2/1997 | Low | 62/622 |
| 5,737,940 | 4/1998 | Yao et al. | 62/620 |
| 5,779,863 | 7/1998 | Ha et al. | 203/74 |

FOREIGN PATENT DOCUMENTS

| | | | |
|---|---|---|---|
| 1730511 | 4/1992 | Russian Federation | 62/621 |
| 1539604 | 1/1979 | United Kingdom | 62/621 |

*Primary Examiner*—William Doerrler
*Attorney, Agent, or Firm*—Browning Bushman

[57] ABSTRACT

The present invention is directed to methods for improving the efficiency and economy of processes for the recovery of natural gas liquids (NGL) from a gas feed, e.g., raw natural gas or a refinery or petrochemical plant gas stream. These methods may be employed with most, if not all, conventional separation methods using a distillation tower, e.g., a demethanizer or deethanizer column. In the methods of the present invention, a portion of a hydrocarbon liquid condensed on a chimney tray disposed below the lowest feed tray of the column is withdrawn from the tower. This withdrawn liquid hydrocarbon is expanded and heated to produce a two-phase system for separation into a heavy, liquid hydrocarbon product and a vapor phase for recycle to the column, preferably as a stripping gas. The withdrawn hydrocarbon liquid is preferably heated by indirect heat exchange with the inlet gas, thus reducing or eliminating the external refrigeration requirements of the process. The expanded, heated vapor recycled to the column increases the ethane and propane concentration in the column, thus reducing the tray temperature profile and increasing the separation efficiency. Accordingly, the column may be operated at lower temperatures and higher pressures, resulting in significant energy savings and economies of operation.

28 Claims, 4 Drawing Sheets

ENHANCED NGL RECOVERY PROCESSES

BACKGROUND OF THE INVENTION

1. Field of the Invention

The present invention is directed toward methods for separating hydrocarbon gas constituents to more efficiently and economically separate and recover both the light, gaseous hydrocarbons and the heavier hydrocarbon liquids. More particularly, the methods of the present invention more efficiently and more economically separate propane, propylene and heavier hydrocarbon liquids (and, if desired, ethane and ethylene) from any hydrocarbon gas stream, e.g., from natural gas or gases from refinery or petrochemical plants.

2. Description of the Background

In addition to methane, natural gas includes some heavier hydrocarbons and other impurities, e.g., carbon dioxide, nitrogen, helium, water and non-hydrocarbon acid gases. After compression and separation of these impurities, natural gas is further processed to separate and recover natural gas liquids (NGL). In fact, natural gas may include up to about fifty percent (50%) by volume of heavier hydrocarbons recovered as NGL. These heavier hydrocarbons must be separated from the methane to provide pipeline quality methane and recovered natural gas liquids. These valuable natural gas liquids comprise ethane, propane, butane and other heavier hydrocarbons. In addition to these NGL components, other gases, including hydrogen, ethylene and propylene, may be contained in gas streams from refinery or petrochemical plants.

Processes for separating hydrocarbon gas components are well known in the art. C. Collins, R. J. J. Chen and D. G. Elliot have provided an excellent, general review of NGL recovery methods in a paper presented at GasTech LNG/LPG Conference 84. This paper, entitled *Trends in NGL Recovery for Natural and Associated Gases*, was published by GasTech, Ltd. of Rickmansworth, England, in the transactions of the conference at pages 287–303. The pre-purified natural gas is treated by well known methods including absorption, refrigerated absorption, adsorption and condensation at cryogenic temperatures down to about −175° F. Separation of the lower hydrocarbons is achieved in one or more distillation towers. The columns are often referred to as demethanizer or deethanizer columns. Processes employing a demethanizer column separate methane and other more volatile components from ethane and less volatile components in the purified gas stream. The methane fraction is recovered as a purified gas for pipeline delivery. The ethane and less volatile components, including propane, are recovered as natural gas liquids. In some applications, however, it is desirable to minimize the ethane content of the NGL. In those applications, ethane and more volatile components are separated from propane and less volatile components in a column generally known as a deethanizer column.

An NGL recovery plant design is highly dependent on the operating pressure of the distillation column. At medium to low pressures, i.e., 400 psia or lower, the recompression horsepower requirement will be so high that the process becomes uneconomical. However, at higher pressures the recovery level of hydrocarbon liquids will be significantly reduced due to the less favorable separation conditions, i.e., lower relative volatility inside the distillation column. Prior art methods have concentrated on operating the distillation column at higher pressures, i.e., 400 psia or higher while attempting to maintain high recovery of liquid hydrocarbons. In order to achieve these goals, some systems have included two towers, one operated at higher pressure and one at lower pressure.

Many patents have been directed to methods for improving this separation technology. For example, see U.S. Pat. No. 4,596,588 describing methods for separating hydrocarbon gases using a two-column system. Many of the methods disclosed in these patents sought to improve the separation technique by either increasing or providing a leaner reflux stream to the distillation column near the top. For example, see U.S. Pat. Nos. 171,964 and 4,278,457. These patents disclose that the separation process may be improved by generating leaner reflux from the feed gas by heat exchange with the overhead vapor stream from a demethanizer column. U.S. Pat. Nos. 4,318,723 and 4,350,511 further teach that the overhead vapor stream should not only be warmed, but also that a portion may be condensed and returned to the distillation column as reflux. In a further modification, U.S. Pat. No. 4,687,499 discloses that the warmed and compressed overhead vapor stream should be further chilled and expanded before return to the demethanizer column as reflux. In a still further variation, U.S. Pat. No. 4,851,020 discloses a process wherein a recycle stream containing liquid is returned to the top of a demethanizer column to improve the ethane recovery in the NGL product. All of these prior art methods attempt to improve the NGL recovery processes by either generating leaner reflux or recycling a portion of the overhead vapor from the demethanizer column.

A significant cost in NGL recovery processes is related to the refrigeration required to chill the inlet gas. Refrigeration for these low temperature recovery processes is commonly provided by external refrigeration systems using ethane or propane as refrigerants. In some applications, mixed refrigerants and cascade refrigeration cycles have been used. Refrigeration has also been provided by turbo expansion or work expansion of the compressed natural gas feed with appropriate heat exchange.

Traditionally, the gas stream is partially condensed at medium to high pressures with the help of either external propane refrigeration, a turboexpander or both. The condensed streams are further processed in a distillation column, e.g., a demethanizer or deethanizer, operated at medium to low pressures to separate the lighter components from the recovered hydrocarbon liquids. Turboexpander technology has been widely used in the last 30 years to achieve high ethane and propane recoveries in the NGL for leaner gas. For richer gas containing significant quantities of heavy hydrocarbons, a combined process of turboexpander and external propane refrigeration is the most efficient approach.

As can be seen from the foregoing description, the prior art has long sought methods for improving the efficiency and economy of processes for separating and recovering natural gas liquids from natural gas. Accordingly, there has been a long-felt but unfulfilled need for more efficient, more economical methods for performing this separation. The present invention provides significant improvements in efficiency and economy, thus solving those needs.

SUMMARY OF THE INVENTION

The present invention is directed to processes for the separation and recovery of natural gas liquids from a hydrocarbon-containing raw gas feed under pressure. In the methods of the present invention, a gas feed is processed in a distillation tower, e.g., a demethanizer or deethanizer column, to separate the lighter hydrocarbon gases from the heavier natural gas liquids (NGL).

In the methods of the present invention, a raw gas feed is cooled and/or expanded by conventional means prior to introduction to a distillation tower at one or more feed trays. Overhead vapors, principally methane, recovered from the column and the reflux stream to the column may be processed in any conventional way such as those described in the patents mentioned above to improve the efficiency and economics of the operation. Less volatile hydrocarbon components are concentrated in the liquid phase and collected in chimney trays at lower levels of the column.

In the methods of the present invention, one or more hydrocarbon liquid streams which have been collected in chimney trays of the column disposed below the lowest feed tray are withdrawn from the tower. At least a portion of the withdrawn liquid is expanded to reduce its pressure, thus producing a two-phase stream. The two-phase stream is separated to produce a component of the NGL product and a vapor stream containing mainly ethane and propane which is reintroduced into the distillation column as a stripping gas.

In a preferred embodiment, the temperature of the withdrawn hydrocarbon liquid is also increased to produce the two-phase stream. In fact, the withdrawn hydrocarbon liquid is preferably heated by indirect heat exchange with the inlet gas stream, thus providing refrigeration of the inlet gas without requiring external refrigeration.

Most, if not all, conventional prior art methods and processes for separating natural gas liquids may be modified to include the improvement of the present invention. Thus, the advantages achieved by recycling a portion of the liquid recovered from a tray disposed below the lowest feed tray of the distillation column may be achieved by modification of existing technology.

The methods of the present invention offer many advantages. Recycle and reintroduction of the vapor phase from the withdrawn hydrocarbon liquid as a stripping gas reduces the overall energy requirement of reboiler heat exchangers used with the distillation column. The warmer the stripping gas, the less use will be required of the bottom reboiler. Another advantage achieved by the recycle of ethane and propane back to the column in this stripping gas is the increased concentration of ethane and propane which significantly reduces the temperature profile of the column. Lower temperatures in the column permit maximization of the use of feed gas for providing reboiler duties and minimizes the need for external refrigeration. Because the liquid product separated and recovered from the two phase stream is much heavier than the final NGL liquid product, the bottom product from the column may contain more light components. Accordingly, the bottom temperature of the column and, thus, the cost of reboiler exchangers may both be further reduced. Not only is the temperature profile in the column reduced, but also the recycled stripping gas increases the relative volatility of the key components by increasing the critical pressures in each embodiment, i.e., methane/ethane or ethane/propane in the demethanizer and deethanizer, respectively, which results in more efficient separation within the tower and increased NGL recovery levels.

As a direct consequence of the above advantages, the methods of the present invention can increase the recovery levels of ethane and heavier hydrocarbons. Further, the operating pressure of the distillation column can be increased, thus reducing the horsepower and energy required to recompress the separated gas. These methods will also reduce the requirement for external refrigeration and maximize the use of inlet gas for providing reboiler duty. By reducing or eliminating the requirement of external reboiler heat, significant energy savings are achieved. The combined energy savings achieved by reducing both recompression horsepower and external refrigeration needs may approach ten percent (10%) or more of the total energy consumption of the separation process. Further, as a result of the above advantages, plant throughput and product revenues may also be increased. The need for external refrigeration is minimized or totally eliminated, as a result of the increased recirculation rate in the present invention. Because of higher operating pressures and more circulation of ethane and propane in the column, the process of the present invention can tolerate a higher concentration of carbon dioxide in the feed gas without the concern of freezing.

Thus, a long-felt but unfulfilled need for more economical and more efficient methods for separating NGL liquids has been met. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein.

While the invention will be described in connection with the presently preferred embodiments, it will be understood that it is not intended to limit the invention to those embodiments. On the contrary, it is intended to cover all alternatives, modifications and equivalents as may be included in the spirit of the invention as defined in the appended claims.

DETAILED DESCRIPTION OF PREFERRED EMBODIMENTS

The present invention permits the recovery of natural gas liquids (NGL) from compressed natural gas and refinery fuel gas feeds with reduced external refrigeration requirements and at higher operating pressures. Because of those conditions, the present invention provides significant improvements in the efficiency and economy of NGL recovery processes.

Figure 2:
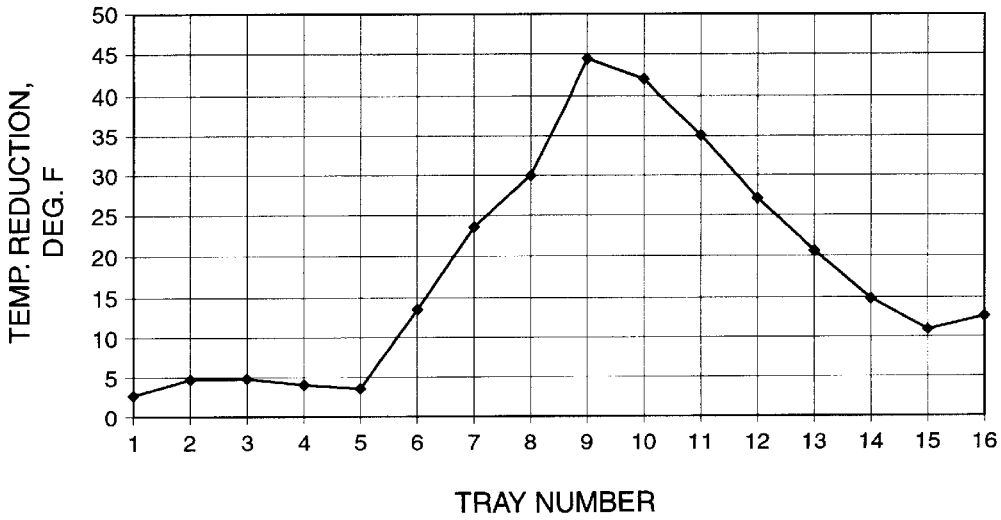
FIG. 2 is a graphical representation of the reduction of tray temperatures which is achievable through use of the process of the present invention as illustrated in FIG. 1.
Figure 3:
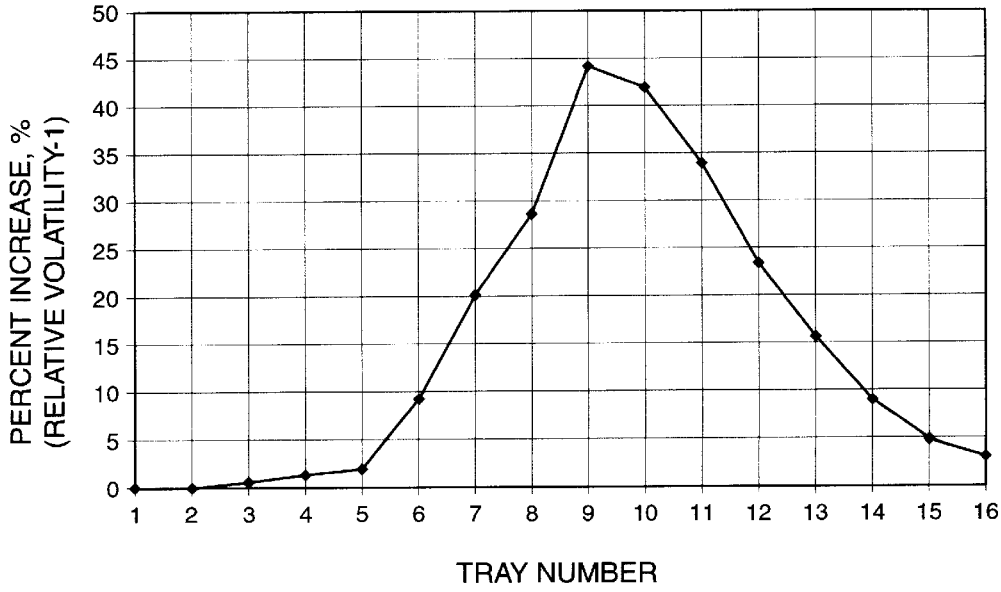
FIG. 3 is a graphical representation of the increased tray relative volatility achievable through use of the process of the present invention as illustrated in FIG. 1.

The method of the present invention, incorporated into an NGL process configured to enhance the recovery of $C_{2+}$ hydrocarbon liquids, i.e., an ethane recovery process, will be described with reference to FIGS. 1–3. To the extent that temperatures and pressures are recited in connection with the methods of the present invention, those conditions are merely illustrative and are not meant to limit the invention.

Figure 1:
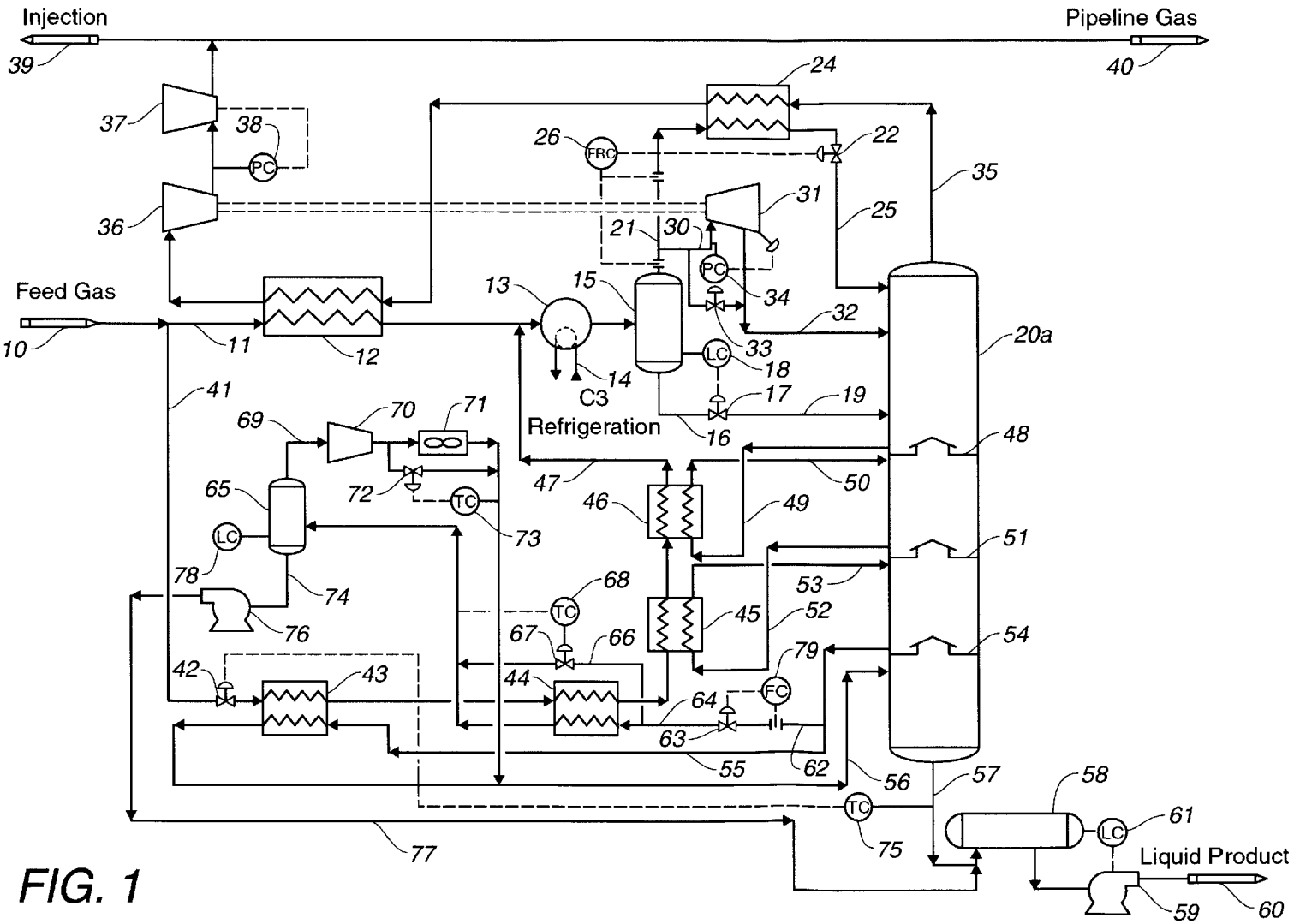
FIG. 1 is a schematic representation of an NGL separation process incorporating the improvements of the present invention and configured to improve the recovery of ethane in the NGL product.

FIG. 1 provides a schematic illustration of such an ethane recovery process with the improvement of the present invention. The inlet gas stream may be provided at an ambient temperature, e.g., about 70° F. Feed gas, typically comprising a clean, filtered, dehydrated natural gas or refinery fuel gas stream is introduced into the illustrated ethane recovery process through inlet 10 at a pressure of about 1015 psia and a temperature of about 110° F. The inlet stream is split into feed stream 11 directed to gas/gas heat exchanger 12 where the temperature of the feed stream is reduced by indirect heat exchange with the overhead vapors from demethanizer column 20*a*. The cooled feed stream flows to gas chiller 13 where propane refrigeration 14 further lowers the temperature to about −30° F. This chilled inlet stream flows to expander feed separator 15 where it is separated into vapor and liquid phases. Liquid hydrocarbons collected at the bottom of feed separator 15 flow through line 16 and line 19 to demethanizer column 20*a* via a level control valve 17. Gases produced in expander feed separator 15 are withdrawn from the top. These cooled gases are split between line 21 directed to reflux exchanger 24 and line 30 directed to expander 31. Gases passing through reflux exchanger 24 are cooled and totally condensed by indirect heat exchange with the overhead vapor phase from demethanizer 20*a*. These condensed streams are directed into the top tray feed of demethanizer 20*a* through valve 22 and feed line 25 at a temperature of about −134° F. and a pressure of about 445 psia. Flow through line 25 is controlled by flow ratio control valve 22 operated by flow ratio controller 26.

Another portion of the vapor extracted from the top of separator 15 flows through line 30 to expander 31. The reduced pressure vapors from expander 31 pass through line 32 into an upper region of demethanizer 20*a*. The configuration illustrated in FIG. 1 further includes J-T valve 33 operated in parallel by split range pressure controller 34 to adjust the flow through line 32.

Overhead vapors produced in demethanizer 20*a* are extracted through line 35 in the top of the unit. Those vapors flow successively to reflux exchanger 24 and gas/gas heat exchanger 12 where they provide indirect heat exchange to cool the inlet gas. The heated overhead vapors then flow to expander-compressor 36 and residue gas recompressor 37 where they are compressed to the desired pipeline pressure, e.g., to about 1000 psia. Adjustment to the desired operating pressure is achieved with pressure controller 38. The separated gas, primarily methane, at the desired pressure may then be injected into the reservoir through injection outlet 39 or directed to a pipeline through pipeline outlet 40.

The foregoing merely provides an exemplary description of a conventional system for processing inlet gas and should not be considered as limiting the methods of the present invention. It is assumed that the methods of the present invention may be used with most, if not all, conventional methods for treating a raw gas feed.

In the methods of the present invention, a portion of the raw gas feed is directed through line 41 to a series of reboiler heat exchangers all providing indirect heat exchange with liquid hydrocarbons condensed within the distillation column. The feed first passes through a temperature control valve 42 operated by a temperature controller 75 sensing the temperature of the bottom NGL product withdrawn in line 57 from demethanizer column 20*a*. The raw gas feed is first cooled in bottom reboiler 43 where its temperature is reduced by indirect heat exchange with a condensed hydrocarbon liquid withdrawn from a lower chimney tray of demethanizer 20*a*. The cooled feed is further chilled by indirect heat exchange in help cooler 44 with the hydrocarbon liquid withdrawn from demethanizer 20*a* serving as the refrigerant. In the illustrated embodiment, the chilled feed is still further cooled by successive passage through warm side reboiler 45 and cold side reboiler 46 before flowing through line 47 to the input side of gas chiller 13. Cooling in reboilers 45, 46 is also provided by indirect heat exchange with liquid hydrocarbons condensed in the lower portion of demethanizer 20*a*. The final temperature of the input stream in line 47 may be as low as about −21° F.

The temperature of the raw feed entering inlet 10 has been significantly reduced by indirect heat exchange in reboilers 43, 44, 45 and 46. This significant benefit is achieved by using the liquid hydrocarbon condensates withdrawn from trays 54, 51 and 48 of demethanizer 20*a*, as the refrigerant. These condensed hydrocarbon liquids have all been withdrawn from trays disposed in the distillation column at locations below the lowest feed tray of the column.

Chimney tray 48 provides liquid condensate through line 49 to provide the refrigerant for cold side reboiler 46. The heated condensate exiting cold side reboiler 46 is returned to demethanizer 20*a*, through line 50. Similarly, chimney tray 51, disposed still lower within demethanizer 20*a*, provides liquid condensate through line 52 as a refrigerant to warm side reboiler 45. The heated condensate is returned via line 53 to demethanizer 20*a*. Finally, in the embodiment illustrated, bottom chimney tray 54 provides liquid condensate through line 55 to bottom reboiler 43 where it absorbs heat from the inlet gas prior to reintroduction to demethanizer 20*a* together with the recycled stripping gas stream through line 56.

A portion of the liquid withdrawn from bottom chimney tray 54 is directed through line 62 to a recycle/stripping loop. Liquid hydrocarbon flowing in line 62 passes through flow control valve 63 operated by flow controller 79 and via line 64 into help cooler 44 where it provides refrigeration to lower the temperature of the inlet gas by indirect heat exchange. The pressure in line 64 is reduced by about 200 psi to the desired pressure via valve 63. The warmed hydrocarbon liquid exiting help cooler 44 is separated in suction knockout drum 65 into vapor and liquid streams. The temperature of the gas entering knockout drum 65 may be adjusted using temperature control valve 67 disposed in bypass line 66 and operated in response to temperature controller 68.

The liquid phase, which is heavier than the final NGL product delivered at outlet 60, accumulates at the bottom of knockout drum 65 where it is withdrawn through line 74. This liquid phase is pumped by recycle pump 76 operated by level controller 78 through line 77 to surge drum 58 for mixing with the NGL liquids withdrawn from the bottom of demethanizer 20*a* through line 57. The final liquid product is pumped by pump 59 operated by level controller 61 to NGL outlet 60.

The vapor phase produced in knockout drum 65 is withdrawn from the top thereof through suction flow line 69 to recycle compressor 70. The repressurized gas exiting compressor 70 is cooled in recycle compressor cooler 71 prior to reintroduction to demethanizer 20*a* as a stripping gas through line 56. The temperature of the compressed, cooled vapor is adjusted using bypass temperature control valve 72 operated by temperature controller 73. Preferably, the temperature of the vapor is adjusted to about 110° F.

In the embodiment illustrated in FIG. 1, the vapor phase recovered from knockout drum 65 contains mainly a mixture of ethane and propane. After this vapor phase is compressed and cooled in recycle compressor 70 and discharge cooler 71, it is preferably recycled to demethanizer column 20*a* as a stripping gas. In the illustrated embodiment, this recycled gas is combined with a return stream from bottom reboiler 43. This recycled gas also provides a lift gas to move the partially-vaporized return stream from bottom reboiler 43 back to the bottom of demethanizer column 20*a*.

The use of this recycled gas as a stripping gas provides significant advantages. This recycled stripping gas reduces the overall requirement of reboiler duty for the distillation column. The warmer the stripping gas, the less demand is placed upon the bottom reboiler. In the example illustrated in Table 1 below, the total external heat requirement has been reduced from about 11 MMBTU per hour to about zero at a constant operating pressure of about 530 psia.

TABLE I

| CASE DESCRIPTION | ETHANE RECOVERY CASES | | | | | | ETHANE REJECTION CASES | | | | | |
|---|---|---|---|---|---|---|---|---|---|---|---|---|
| | BASE H. PRES | PATENT H. PRES | BASE L. PRES | PATENT H. RECO. L. PRES | PATENT L. COM,P. L. PRES | PATENT SELECT L. PRES | BASE H. PRES | PATENT H. PRES | BASE H. PRES | PATENT H. PRES | BASE L. PRES | PATENT L. PRES |
| PRODUCT RECOVERY | C2+ | C2+ | C2+ | C2+ | C2+ | C2+ | C3+ | C3+ | C3+ | C3+ | C3+ | C3+. |
| TOTAL PLT VOLUME, MMSCFD | 500 | 500 | 500 | 500 | 500 | 525 | 500 | 500 | 500 | 500 | 500 | 500 |
| INLET GAS PRESS, PSIA. | 1015 | 1015 | 1015 | 1015 | 1015 | 1015 | 1015 | 1015 | 1015 | 1015 | 1015 | 1015 |
| RESIDUE GAS PRESS., PSIA | 1000 | 1000 | 1000 | 1000 | 1000 | 1000 | 1000 | 1000 | 1000 | 1000 | 1000 | 1000 |
| DE-METH. TOWER PRESS., PSIA | 530 | 530 | 395 | 390 | 440 | 450 | 510 | 510 | 510 | 510 | 450 | 450 |
| DE-METH. BTM. TEMP., DEG. F. | 146 | 120 | 84 | 75 | 90 | 93 | 257 | 210 | 309 | 237 | 251 | 215 |
| PROPANE REFRIGERANT, DEG. F. | −27 | −27 | −35 | −35 | −35 | −35 | −17 | −17 | −20 | −20 | −20 | −18 |
| CRITICAL PRES. @ TRAY 8, PSIA | 1163 | 1439 | 1283 | 1486 | 1452 | 1445 | 861 | 874 | 787 | 818 | 785 | 810 |
| CRITICAL PRES. @ TRAY 15, PSIA | 925 | 940 | 959 | 959 | 951 | 952 | 710 | 746 | 663 | 692 | 685 | 694 |
| RECOMP. HORSEPOWER, BHP | 16,537 | 15,936 | 24,405 | 25,077 | 21,623 | 22,055 | 17,726 | 18,225 | 18,538 | 18,392 | 21,678 | 21,922 |
| PERCENT COMP. HP SAVING, % | −32.2 | −34.7 | — | 2.7 | −11.4 | −9.6 | −18.2 | −15.9 | −14.5 | −15.2 | — | 1.1 |
| ETHANE RECOVERY LEVEL, % | 48 | 62 | 86 | 91 | 86 | 84 | 0 | 0 | 0 | 0 | 0 | 0 |
| PRODUCT RECOVERY C2, Bbl/D | 13,067 | 16,761 | 23,152 | 24,659 | 23,174 | 23,865 | — | — | — | — | — | — |
| PERCENT INCREASE, % | — | 28.3 | — | 6.5 | — | 3.1 | — | — | — | — | — | — |
| PROPANE RECOVERY LEVEL, % | 95 | 96 | 99 | 99 | 99 | 98 | 73 | 82 | 34 | 63 | 73 | 85 |
| PRODUCT RECOVERY C3+, BbI/D | 28,394 | 28,508 | 28,795 | 28.821 | 28,767 | 30,189 | 26,539 | 27,465 | 22,424 | 25,534 | 26,541 | 27,819 |
| PERCENT INCREASE, % | — | 0.4 | — | 0.1 | — | 4.8 | — | 3.5 | — | 13.9 | — | 4.8 |
| C2/C3 IN C3+ PRODUCT, MOL % | 2.0 | 2.0 | 2.0 | 2.0 | 2.0 | 2.0 | 10.0 | 10.0 | 2.0 | 2.0 | 2.0 | 2.0 |
| L.S. C3 REFRI., MMBTU/HR/TRAIN | 12.9 | 12.5 | 9.9 | 10.0 | 9.6 | 9.6 | 11.3 | 12.1 | 11.5 | 11.8 | 12.0 | 12.8 |
| L.S. PROPANE REFRI., BHP/TRAIN | 2,709 | 2,625 | 2,280 | 2,303 | 2,211 | 2,211 | 2,147 | 2,299 | 2,277 | 2,336 | 2,376 | 2,458 |
| C2 RECYCLE COMPR., BHP/TRAIN | 0 | 2008 | 0 | 1,167 | 1,152 | 1.166 | 0 | 1501 | 0 | 1575 | 0 | 1,241 |
| TOTAL HEAT, MMBTU/HR | 11 | 0 | 0 | 0 | 0 | 0 | 33 | 16 | 39 | 20 | 38 | 23 |

Further, use of this recycle gas as the stripping gas recycles ethane and propane back to demethanizer column 20*a* to increase the concentration of ethane and propane therein. This reduces the temperature profile within the column, especially for trays in the middle of the column. The reduction of tray temperature in the column achieved at a constant operating pressure (490 psia) is illustrated in FIG. 2. The temperature of tray 9 has been reduced by 45° F. in this example while the temperature of trays 8 to 11 have all been reduced by at least 30° F. These trays typically are associated with the cold and warm side reboilers 46 and 45, respectively. This significant temperature reduction makes the heat integration inside reboiler exchangers 43, 44 much easier and maximizes the use of inlet gas for providing reboiler duty. Therefore, the requirement for external reboiler heat may be completely eliminated for medium to high ethane recovery cases, e.g., cases where ethane recovery is greater than about 40% at pressures higher than about 450 psia.

Because the recycle of gas from knockout drum 65 as stripping gas increases the content of ethane and propane in demethanizer 20*a*, the relative volatility of the two components, i.e., ethane/propane, is also increased. Relative volatility herein is defined as the ratio of the K- values of the key light and heavy components, i.e., methane and ethane in this example. Since no separation is expected when the relative volatility approaches unity, the value of (relative volatility −1) is a good indicator of the potential for separation. The resulting increase in relative volatility between the two components enhances the separation efficiency inside the tower and increases the recovery of natural gas liquids. The percent increase in the value of (relative volatility −1) between methane and ethane at the same operating pressure is illustrated in FIG. 3. The (relative volatility −1) at tray 9 has been increased by almost 45%, while the (relative volatility −1) at trays 8 to 11 has been increase by more than 28%.

Thus, it is seen that the method of the present invention wherein hydrocarbon liquids withdrawn from a chimney tray below the lowest feed tray and recycled to produce, in part, a recycled stripping gas provides a significant improvement over a typical expander plant design. Plant operation will be improved in several ways. For example, the recoverable ethane may be increased at least six percent (6%) at the same operating pressure, e.g., 390 psia. The recovery level was increased from 86% to over 91% in the example summarized in Table 1. This advantage should be further improved at higher operating pressures. In fact, a simulation shows that the recoverable ethane should be increased by twenty-eight percent (28%) at an operating pressure of 530 psia. Generally, the degree of enhancement increases in proportion to the operating pressure.

Another significant advantage is achieved by the present invention reducing the horsepower required to recompress the produced gas. Reductions of at least eleven percent (11%) in required recompression horsepower, while maintaining the same liquid recovery level, may be achieved by operating demethanizer column 20*a* at much higher pressures. As a result of its ability to maintain high ethane recovery at much higher operating pressures, it is expected that plant throughput may be increased as much as ten percent (10%), thus increasing product revenues by the same percent.

Figure 4:
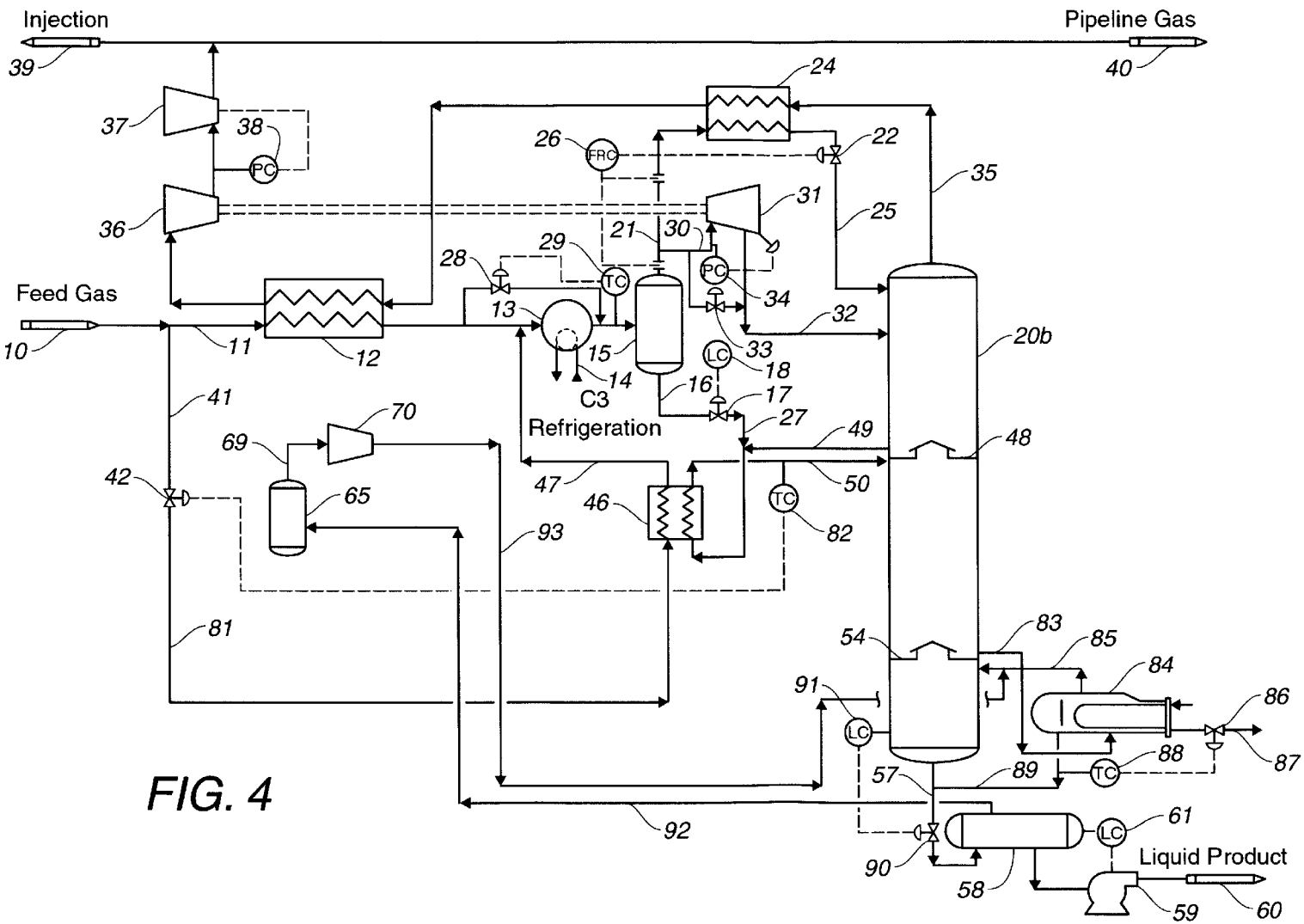
FIG. 4 is a schematic representation of an NGL separation process incorporating the improvements of the present invention and configured to improve the recovery of propane while minimizing the ethane content in the recovered NGL product.
Figure 5:
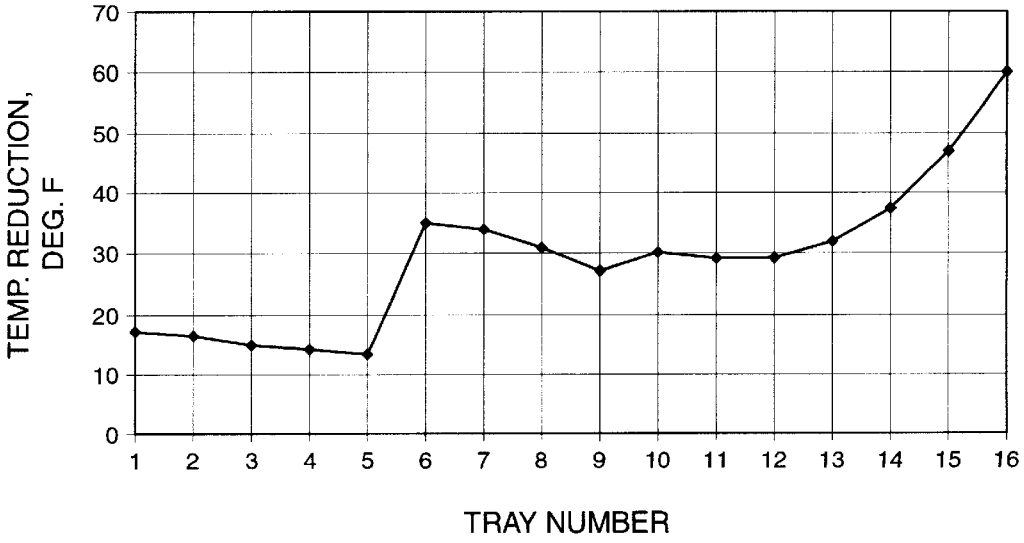
FIG. 5 is a graphical representation of the reduction of tray temperatures which is achievable through use of the process of the present invention as illustrated in FIG. 4.
Figure 6:
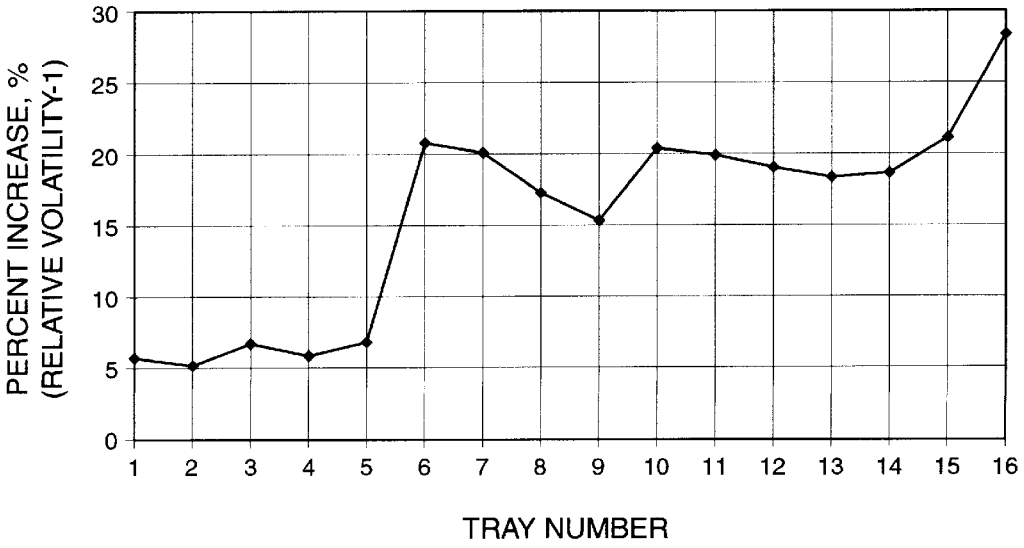
FIG. 6 is a graphical representation of the increased tray relative volatility achievable through use of the process of the present invention as illustrated in FIG. 4.

A second preferred embodiment of the method of the present invention is described with reference to FIGS. 4–6. The method of the present invention, incorporated into an NGL process configured to enhance the recovery of $C_{3+}$ hydrocarbon liquids, i.e., an ethane rejection process, will be described with reference to FIGS. 4–6. FIG. 4 provides a schematic illustration of an ethane rejection process designed to minimize the content of ethane in the NGL product and configured to include the improvement of the present invention.

In the embodiment of FIG. 4, the raw gas feed is introduced at inlet 10 at a pressure of about 1015 psia. The gas feed is cooled in heat exchanger 12 and gas chiller 13 prior to expansion and separation in separator 15. Liquid hydrocarbons accumulated in the bottom of expander 15 flow through line 16 and level control valve 17 to line 27 and, after combination with condensed hydrocarbon liquids accumulated on chimney tray 48 of deethanizer column 20*b* are heated in cold side reboiler 46 prior to introduction to deethanizer 20*b* via line 50. The temperature of the inlet feed into separator 15 may be controlled by adjustment of temperature control valve 28 in a by-pass line in response to temperature controller 29. Processing of the gas vapors produced in separator 15 and of the overhead vapors withdrawn via line 35 from deethanizer 20*b* is identical to that of the method illustrated in FIG. 1 and, accordingly, will not be described in further detail.

A portion of the inlet feed flows via line 41 through temperature control valve 42 responsive to temperature controller 82 and line 81 to cold side reboiler 46 where it is cooled by indirect heat exchange prior to introduction to gas chiller 13 through return line 47.

Hydrocarbon liquids which have condensed in a chimney tray lower than the lowest feed tray are removed from deethanizer column 20*b* for partial recycle. In the process illustrated in FIG. 4, liquids condensed on bottom chimney tray 54 flow through line 83 to bottom reboiler 84 where it is partially vaporized via heating medium line 87. Vapors produced in bottom reboiler 84 are returned to deethanizer column 20*b* through line 85. Liquids produced in reboiler 84 flow through line 89 to combine with hydrocarbon liquids flowing from the bottom of deethanizer column 20*b* in line 57. This combined flow of liquid hydrocarbons passes through level control valve 90 operated by level controller 91 to surge drum 58. The operating pressure in surge drum 58 is reduced via valve 90 to an optimal pressure, typically a reduction of about 200 psi. Liquid hydrocarbons accumulated in surge drum 58 are pumped through liquid product outlet 60 to an appropriate pipeline or storage facility. Heating medium exiting the bottom reboiler 84 flows through temperature control valve 86 operated by temperature controller 88 to a conventional external heat source.

In this embodiment, the hydrocarbon vapors accumulated in surge drum 58 flow through line 92 to suction knockout drum 65. Vapors extracted from knockout drum 65 flow through line 69 to recycle compressor 70. After compression, the vapors are returned as a stripping gas near the bottom of deethanizer column 20*b* via return line 93 to line 85.

In the method illustrated in FIG. 4, a liquid hydrocarbon product condensed at the bottom of deethanizer column 20*b* is flashed to a lower pressure to produce a two-phase stream. The two-phase stream is separated in liquid product surge drum 58. The liquid phase, containing heavier components, is pumped to the pipeline via outlet 60 as the liquid product. The vapor phase, containing a mixture of ethane and propane, is recycled back to deethanizer column 20*b* via recycle compressor 70 for use as a stripping gas. In the embodiment illustrated in FIG. 4, the recycle of stripping gas is combined with the return stream from the bottom reboiler.

When incorporated in a deethanizer process illustrated in FIG. 4, the method of the present invention provides advantages substantially the same as those described above in connection with the demethanizer embodiment. Again, because the concentration of ethane and propane in deethanizer column 20*b* is increased, the temperature profile of the trays therein is significantly reduced, particularly those trays close to the bottom of the column. See the results illustrated in FIG. 5. Because of this reduction in tray temperature profile, the inlet gas may be used to provide cold side reboiler duty at reboiler 46. Therefore, the requirement of external reboiler heat through conventional sources may be reduced by up to at least 40%. Because the recycled gas used for stripping increases the concentration of ethane and propane in deethanizer column 20*b*, the relative volatility of those two components is also increased. Thus, the separation efficiency inside the tower and, accordingly, the recovery of hydrocarbon liquids are both increased.

An NGL recovery process in accord with that illustrated in FIG. 4 provides a significant improvement over a typical expander plant design. Expected improvements include increased recovery of propane and heavier hydrocarbons by about 5 percent (5%) at constant operating pressure. In one example, the propane recovery level was increased from about 34% to over 63% with a stringent ethane specification or from about 73% to 82% with a relaxed ethane specification. See the results illustrated in Table 1 above. Generally, the degree of enhancement increases for more stringent ethane specification and as the operating pressure increases. As in the de-methanization case, the horsepower required to recompress the produced gas is reduced by at least eleven percent (11%) while maintaining the same liquid recovery level by operating the deethanizer column at much higher pressures. As a result of the ability to maintain high liquid recovery at higher operating pressures, it is expected that plant throughout can be increased by at least ten percent (10%) resulting in a similar increase in product revenues.

The foregoing description has been directed in primary part to two particular preferred embodiments in accordance with the requirements of the Patent Statutes and for purposes of explanation and illustration. It will be apparent, however, to those skilled in the art that many modifications and changes in the specifically described methods and apparatus may be made without departing from the true scope and spirit of the invention. Therefore, the invention is not restricted to the preferred embodiments described and illustrated but covers all modifications which may fall within the scope of the following claims.

What is claimed is:

1. A process for the separation of $C_{2+}$ or $C_{3+}$ hydrocarbons from a hydrocarbon-containing gas feed under pressure, comprising:

introducing a cooled gas feed condensate into a distillation column at one or more feed trays, said column having a plurality of liquid recovery trays;

condensing hydrocarbon liquids in said recovery trays;

withdrawing a condensed, hydrocarbon liquid from one or more recovery trays disposed below the lowest feed tray in said column;

reducing the pressure of at least a portion of said withdrawn liquid to preferentially vaporize some of said withdrawn liquid and produce a two phase stream;

separating said two phase stream into a vapor stream for use as an enhancement vapor and a liquid stream;

increasing the pressure of said enhancement vapor; and reintroducing said pressurized enhancement vapor back into said distillation column.

2. The process of claim 1 further comprising passing said gas feed and said portion of said withdrawn liquid through a heat exchanger to reduce the temperature of said feed and increase the temperature of said portion of withdrawn liquid.

3. The process of claim 1 comprising reducing the temperature of said enhancement vapor before reintroducing said enhancement vapor into said column.

4. The process of claim 1 comprising increasing the temperature of said enhancement vapor before reintroducing said enhancement vapor into said column.

5. The process of claim 1 wherein said enhancement vapor is reintroduced into said column below the lowest tray of said column.

6. The process of claim 5 wherein said enhancement vapor increases the traffic of ethane and propane inside said column.

7. The process of claim 6 wherein said increased traffic of ethane and propane in said column reduces the tray temperature profile and enhances the separation efficiency in said column.

8. The process of claim 1 wherein said liquid is withdrawn from the lowest tray in said column.

9. The process of claim 1 wherein said liquid is withdrawn from the bottom of said column.

10. The process of claim 1 wherein said enhancement vapor is reintroduced into said column below the tray from which said liquid was withdrawn.

11. The process of claim 1 wherein said column is operated with a bottom temperature of about 0° F. to about 350° F. and a top temperature of about −160° F. to about 0° F.

12. The process of claim 1 wherein said column is operated at a pressure of about 150 psia to about 700 psia.

13. The process of claim 1 wherein said vapor stream mainly comprises a mixture of ethane and propane.

14. A process for the separation of $C_{2+}$ or $C_{3+}$ hydrocarbons from a hydrocarbon-containing gas feed under pressure, comprising:

introducing a cooled gas feed condensate into a distillation column at one or more feed trays, said column having a plurality of liquid recovery trays;

condensing hydrocarbon liquids in said recovery trays;

withdrawing a condensed, hydrocarbon liquid from one or more recovery trays disposed below the lowest feed tray in said column;

reducing the pressure and increasing the temperature of at least a portion of said withdrawn liquid to produce a two phase stream;

separating said two phase stream into a vapor stream and a liquid stream; and reintroducing said vapor stream back into said distillation column.

15. The process of claim 14 comprising passing said gas feed and said portion of said withdrawn liquid through a heat exchanger to reduce the temperature of said feed and increase the temperature of said portion of withdrawn liquid.

16. The process of claim 14 comprising increasing the pressure and decreasing the temperature of said vapor stream before reintroducing said vapor stream into said column.

17. The process of claim 14 wherein said vapor stream is reintroduced into said column below the lowest tray to provide a stripping gas for said column.

18. The process of claim 17 wherein said stripping gas increases the traffic of ethane and propane inside said column.

19. The process of claim 18 wherein said increased traffic of ethane and propane in said column reduces the tray temperature profile and enhances the separation efficiency in said column.

20. The process of claim 14 wherein said liquid is withdrawn from the lowest tray in said column.

21. The process of claim 14 wherein said liquid is withdrawn from the bottom of said column.

22. The process of claim 14 wherein said vapor stream is reintroduced into said column below the tray from which said liquid was withdrawn.

23. The process of claim 14 wherein said column is operated with a bottom temperature of about 0° F. to about 350° F. and a top temperature of about −160° F. to 0° F.

24. The process of claim 14 wherein said column is operated at a pressure of about 150 psia to about 700 psia.

25. The process of claim 14 wherein said vapor stream mainly comprises a mixture of ethane and propane.

26. An apparatus for separating $C_{2+}$ or $C_{3+}$ hydrocarbons from a hydrocarbon-containing gas feed under pressure, comprising:

a distillation column having a plurality of liquid feed and recovery trays;

means for introducing a cooled gas feed condensate into said distillation column at one or more of said feed trays;

means for withdrawing a condensed, hydrocarbon liquid from one or more of said recovery trays disposed below the lowest feed tray in said column;

means for reducing the pressure of at least a portion of said withdrawn liquid to preferentially vaporize some of said withdrawn liquid and produce a two phase stream;

means for separating said two phase stream into a vapor stream for use as an enhancement vapor and a liquid stream;

means for increasing the pressure of said enhancement vapor; and means for reintroducing said pressurized enhancement vapor back into said distillation column.

27. The apparatus of claim 26 further comprising means for increasing the temperature of said portion of said withdrawn liquid.

28. The apparatus of claim 27 wherein said means for increasing the temperature comprises one or more indirect heat exchangers in which the portion of said withdrawn liquid provides refrigeration to at least a portion of said gas feed.

* * * * *